US008985959B1

(12) United States Patent
Kuykendall et al.

(10) Patent No.: US 8,985,959 B1
(45) Date of Patent: Mar. 24, 2015

(54) TURNING KNOB BLADE LOCKING DEVICE, SYSTEM AND METHOD

(75) Inventors: Dennis C. Kuykendall, Greer, SC (US); Brendan Byrne, Germantown, TN (US)

(73) Assignee: Palm Coast Imports, LLC, Germantown, TN (US)

( * ) Notice: Subject to any disclaimer, the term of this patent is extended or adjusted under 35 U.S.C. 154(b) by 410 days.

(21) Appl. No.: 13/459,568

(22) Filed: Apr. 30, 2012

Related U.S. Application Data

(60) Provisional application No. 61/603,072, filed on Feb. 24, 2012.

(51) Int. Cl.
*F04D 29/34* (2006.01)

(52) U.S. Cl.
USPC ..... 416/210 R

(58) Field of Classification Search
CPC ..... F04D 29/34; F04D 25/088
USPC ..... 416/210 R, 204 R, 5, 206, 207; 411/349, 411/549, 553
See application file for complete search history.

(56) References Cited

U.S. PATENT DOCUMENTS

| | | | | |
|---|---|---|---|---|
| 3,549,184 | A | 12/1970 | Anderson | |
| 4,186,952 | A | 2/1980 | Glass | |
| 4,331,413 | A | 5/1982 | Hoen | |
| 4,420,859 | A | 12/1983 | Hammerle | |
| 6,267,543 | B1 | 7/2001 | David | |
| 6,371,729 | B1 * | 4/2002 | Tseng | 416/210 R |
| 6,758,626 | B1 * | 7/2004 | Tseng | 416/210 R |
| 6,932,576 | B2 | 8/2005 | Bird | |
| 7,223,078 | B1 | 5/2007 | Mares | |
| 7,527,478 | B2 * | 5/2009 | Pearce | 416/210 R |
| 8,356,979 | B2 * | 1/2013 | Haynes | 416/210 R |

* cited by examiner

*Primary Examiner* — Richard Edgar

(57) ABSTRACT

Devices, systems and methods of using a single turning knob and blade holder posts to align and lock a ceiling fan blade to a blade holder. An assembler can fit a blade with a matched pattern of openings over the upwardly protruding locating features on the blade holder until the blade bottoms on the holder. The knob is turned clockwise to lock in place against the stop feature on the pedestal, and counter-clockwise to unlock. Spring loaded detents can lock the turning knob in place in a counter-clockwise direction.

13 Claims, 7 Drawing Sheets

TURNING KNOB BLADE LOCKING DEVICE, SYSTEM AND METHOD

CROSS REFERENCE TO RELATED APPLICATIONS

This invention claims the benefit of priority to U.S. Provisional Application 61/603,072 filed Feb. 24, 2012.

FIELD OF INVENTION

This invention relates blade connecting devices, and in particular to devices, systems and methods of using a single turning knob and blade arm mounted posts to align and lock ceiling fan blades to a ceiling fan blade bracket.

BACKGROUND AND PRIOR ART

It is common to attach ceiling fan blades to blade brackets and holders of ceiling fans by screwing fasteners, such as screws, to attach the blades to ceiling fan brackets, where the brackets are attached to motors. Ceiling fan blades are difficult and tedious to assemble. Several small screws and washers need to be screwed through the blade and into the blade holder using a screw driver while holding the blade and blade holder in place.

Most ceiling fans require time and effort to assemble a blade with a blade holder. Many extra parts are needed and a tool is usually required for assembly. The hardware can be easily dropped, misplaced or lost.

Various types of alternatives have been proposed.

U.S. Pat. No. 6,758,626 to Tseng uses twistable knobs to attach blades in a ceiling fan. However, this device requires three twistable knobs, and that each of the knobs and their support posts must be oval shaped, and also requires keeping an air space between the blade and the arm in the locked position, which ends of with multiple parts and assembly time.

U.S. Pat. No. 6,932,576 to Bird shows and describes a connecting mechanism which uses one twisting knob. However, this device requires the installer to catch upwardly protruding inverted L shaped fasteners on a blade bracket to catch into holes in the blade. Next, a separated knob must be then inserted into another hole in the blade to be twisted. Having separated parts, such as the separate knob, can be easily lost and misplaced, similar to loose screws that are used to traditionally attach ceiling blades to ceiling fans. In addition, the catches can make it difficult for someone to angle the blade to assemble.

Thus, the need exists for solutions to the above problems with the prior art.

SUMMARY OF THE INVENTION

A primary objective of the present invention is to provide devices, systems and methods of using a single pre-attached turning knob and blade arm mounted posts to align and lock a ceiling fan blade to a ceiling fan blade bracket/iron.

A secondary objective of the present invention is to provide devices, systems and methods of soundly connecting a blade to a blade holder without using any tools or loose hardware, where the assembly is intuitive and fast.

The novel invention device, system and method requires no tools, loose parts, or hardware. The blade is simply aligned and placed over the locating pins in the blade holder and locked into place using the turning knob.

The claimed invention differs from what currently exists. Our invention requires no tools to install. The entire assembly process takes seconds compared to several minutes for other systems. There is no loose hardware or parts that could be dropped or lost. The assembly is intuitive, no instructions are needed.

Although existing systems work effectively, they are much more problematic in assembly and require more time and effort as well as a separate tool for assembly.

The locking system can use a rectangular pedestal/block mounted to the outer end of the blade bracket/holder. The longitudinal axis of the mounted block can be perpendicular to both the longitudinal axis of the blade bracket and the long axis of the ceiling fan blade. The top of the block can have a flat top surface with one or two upwardly protruding portions at opposite diagonal corners, which function as stops.

A center of the plastic knob can be rotatably attached to the top surface of the block by a screw. Before the assembler attaches the blade to the bracket, the knob has been pre-attached to the bracket. The knob can have a generally rectangular footprint with a base having a longitudinal ridge that runs down the middle of the base and slightly angled side portions which angle upward about 10 degrees to each side of the base.

Extending upward from the knob can be a pair of spaced apart ear shaped flanges, which function as a grip for the installer. Additionally extending upward from the blade bracket/holder can be a triangular arrangement of posts with the block located in the middle of the triangular arrangement.

The end of the ceiling fan blade can have either a large rectangular shaped slot or a large oval shaped slot having a similar length and width to the block. About the large slot can be a triangular arrangement of through-holes, each being slightly larger than the diameter of each of the posts on the mounting arm.

At rest position, the knob can sit directly on the block so that the rectangular perimeter edges of the knob are aligned with the rectangular perimeter edges of the block. To attach the blade to the arm, the blade is oriented so that the large slot fits over both the knob and block in its rest position, and the triangular arrangement of through-holes on the blade are aligned to slip over the triangular arrangement of posts. The blade is moved downward so that surface area of the blade around the large slot and triangular holes rests directly against the surface area of the mounting arm which is located around the block and posts.

Next, the knob can be gripped by the flange ears so that the knob is rotated clockwise until sides of the knob abut against the diagonally oriented stops that protrude up from the block. The stops generally allow for the knob to move to a generally perpendicular orientation relative to the block, which locks the blade to the arm. To remove the blade, the knob is rotated counter-clockwise back to the rest position, and the blade is lifted off from the block and posts.

Another version allows for a depressible spring having an upper portion, such as a ball, which passes into a depression in a bottom portion of the knob, when the knob is rotated approximately 90 degrees from its' rest position. With this version, the knob is rotated counter-clockwise to lock, and clockwise to unlock.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Figure 1:
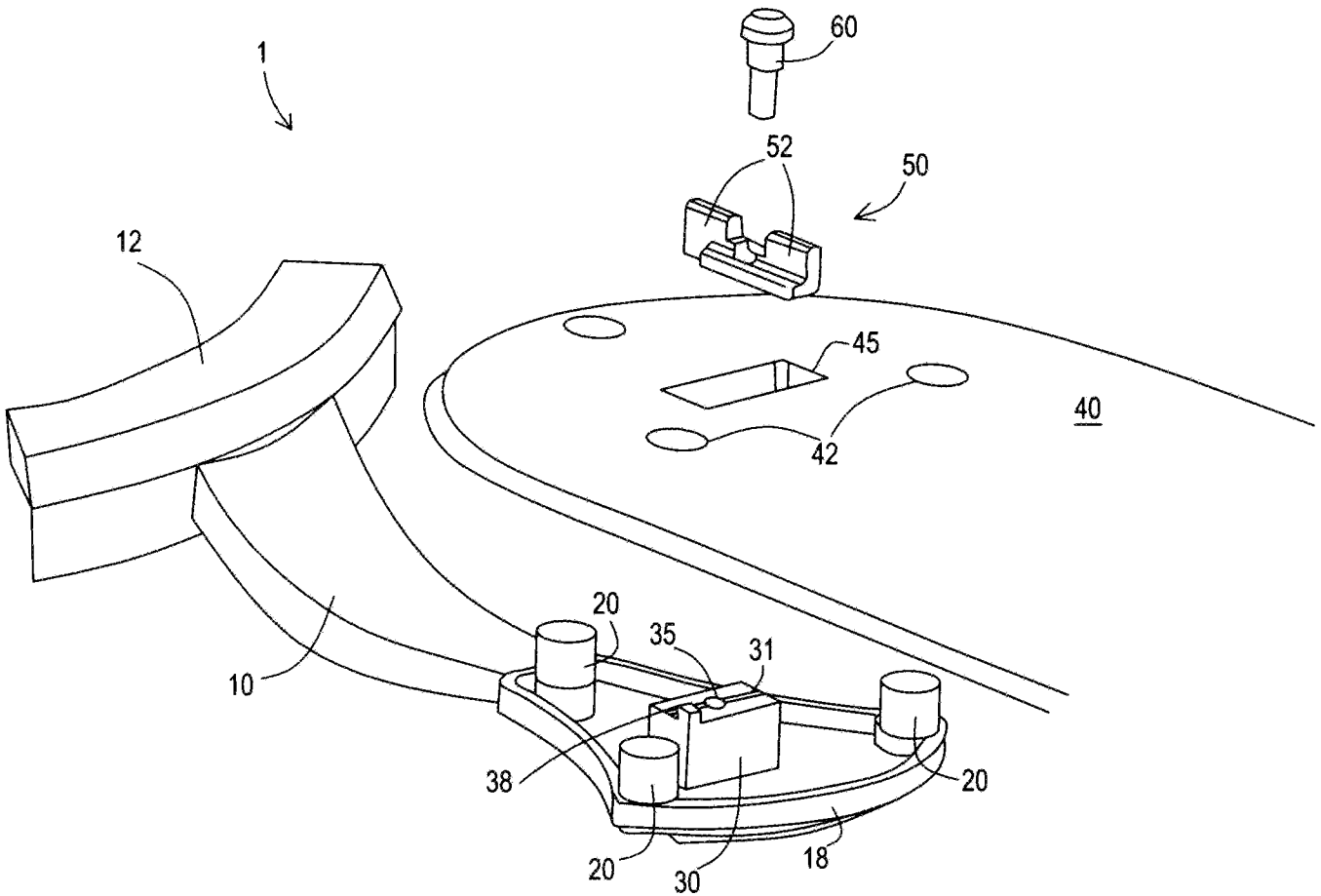
FIG. 1 is an exploded view of a single turning knob and blade arm posts with ceiling fan blade and blade bracket.

1. twist knob blade locking assembly
10. blade bracket/iron/holder
12. motor end
18. blade end
20. locating and alignment posts/pins
30. pedestal/locating block
31. top surface
32. channel in pedestal for spring
35. opening in pedestal for shoulder screw
38. upwardly protruding stop
40. ceiling fan blade
42. alignment cylindrical holes
45. rectangular elongated knob fastening slot
50. turning knob
52. flange gripping ears
54. base
55. hole in base for fastener screw/bolt
56. raised lower ridge
57. first sloped lower surface
59. second sloped lower surface
60. shoulder screw
100. oval knob fastening slot version
200. spring stop version
210. detent ball
212. ledge around top of channel
220. spring
230. post bases
232. post tops
250. turning knob
254. bottom of knob
256. detent/depression in bottom of knob FIG. 1 is an exploded view of the twist knob blade locking assembly 1 that can include a blade iron/bracket that can be attached to a motor of a ceiling fan (not shown) at a motor attachment end 12, and an opposite end 18 for attachment to a ceiling fan blade 40. The blade attachment end 18 can include a generally centrally located upwardly protruding pedestal 30 with a top surface 31 having an central opening 35 with internal threads for receiving a shoulder screw 60, along with three upwardly protruding alignment posts 20 that can be arranged in a triangular arrangement about the pedestal 30. On one corner of the top surface 31 of the pedestal 30 can be a upwardly protruding stop 38.

The assembly 1 can further include a blade 40 having up to three holes 42 arranged in a triangular configuration about an elongated rectangular slot opening 45, which can have an elongated axis that is generally perpendicular to the longitudinal axis between the root and tip end of the blade 40

Figure 2B:
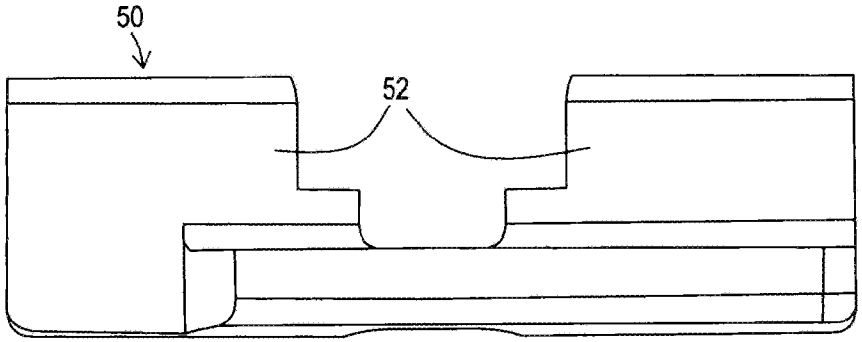
FIG. 2B is a side view of the knob of FIG. 1.
Figure 3:
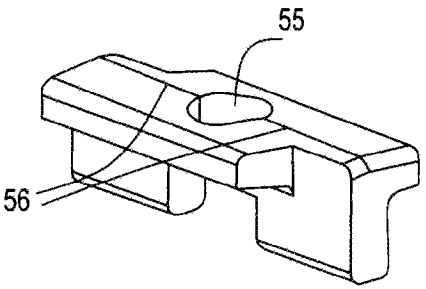
FIG. 3 is a perspective view of the knob bottom of FIG. 1.
Figure 2A:
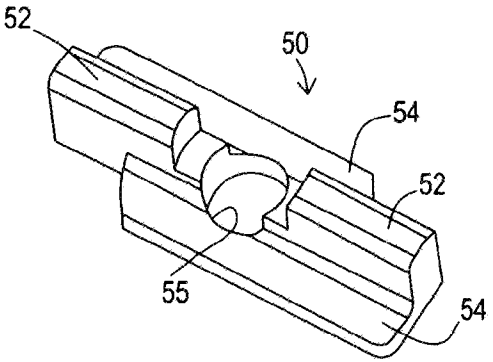
FIG. 2A is an enlarged upper side perspective view of the turning knob of FIG. 1.
Figure 2C:
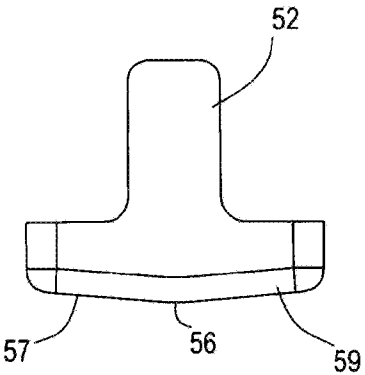
FIG. 2C is an end view of the knob of FIG. 2B.

FIG. 2A is an enlarged upper side perspective view of the turning knob 50 of FIG. 1. FIG. 2B is a side view of the knob 50 of FIG. 1. FIG. 2C is an end view of the knob 50 of FIG. 2B. FIG. 3 is a perspective view of the knob bottom (Base) 54 of FIG. 1.

Referring to FIGS. 1-3, the turning knob 50 can have an elongated rectangular configuration with upwardly facing gripping ears 52, and a hole 55 in the base 54 for the shoulder screw 60. Extending below the base 54 can be a raised ridge 56 running along the length with sloped surfaces 57, 59 on both sides of the raised ridge 56.

The shoulder screw 60 allows for the turning knob 50 to be fully tightened and secured to the blade bracket 10 while maintaining adequate space for the knob 50 to rotate freely. The screw 60 allows for the knob 50 to be pre-attached to the pedestal 30 so that there are no separate loose parts.

Figure 4A:
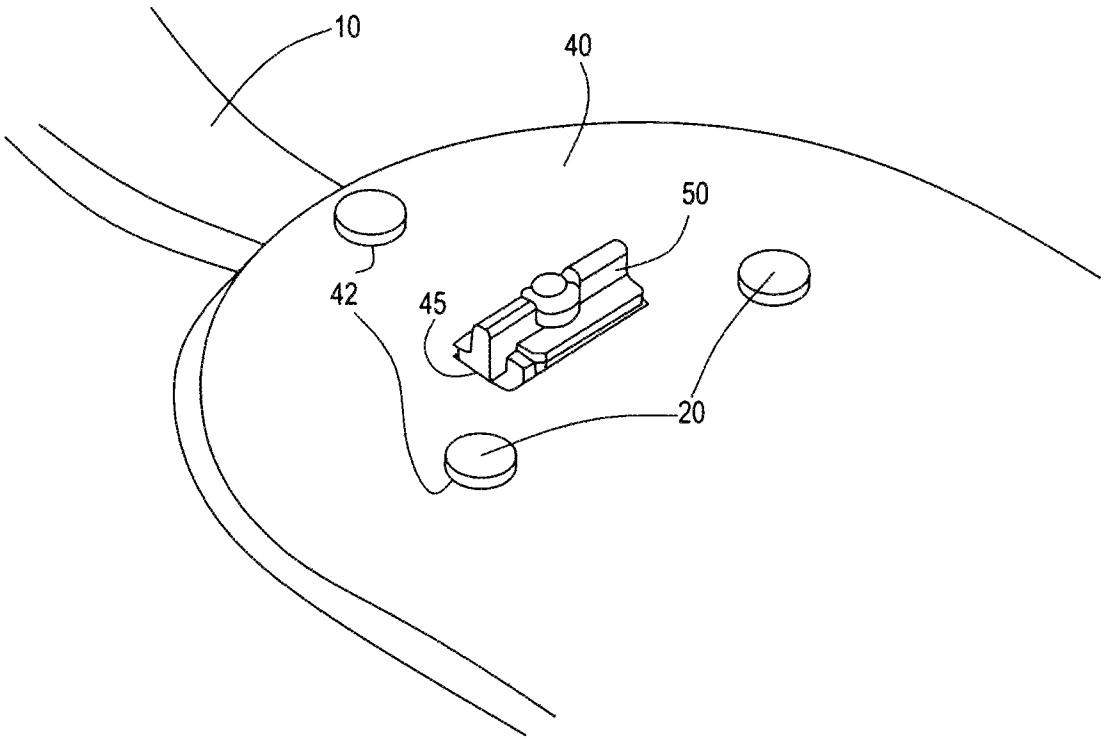
FIG. 4A is a perspective view of the assembled blade and bracket with knob in blade loading position.
Figure 4B:
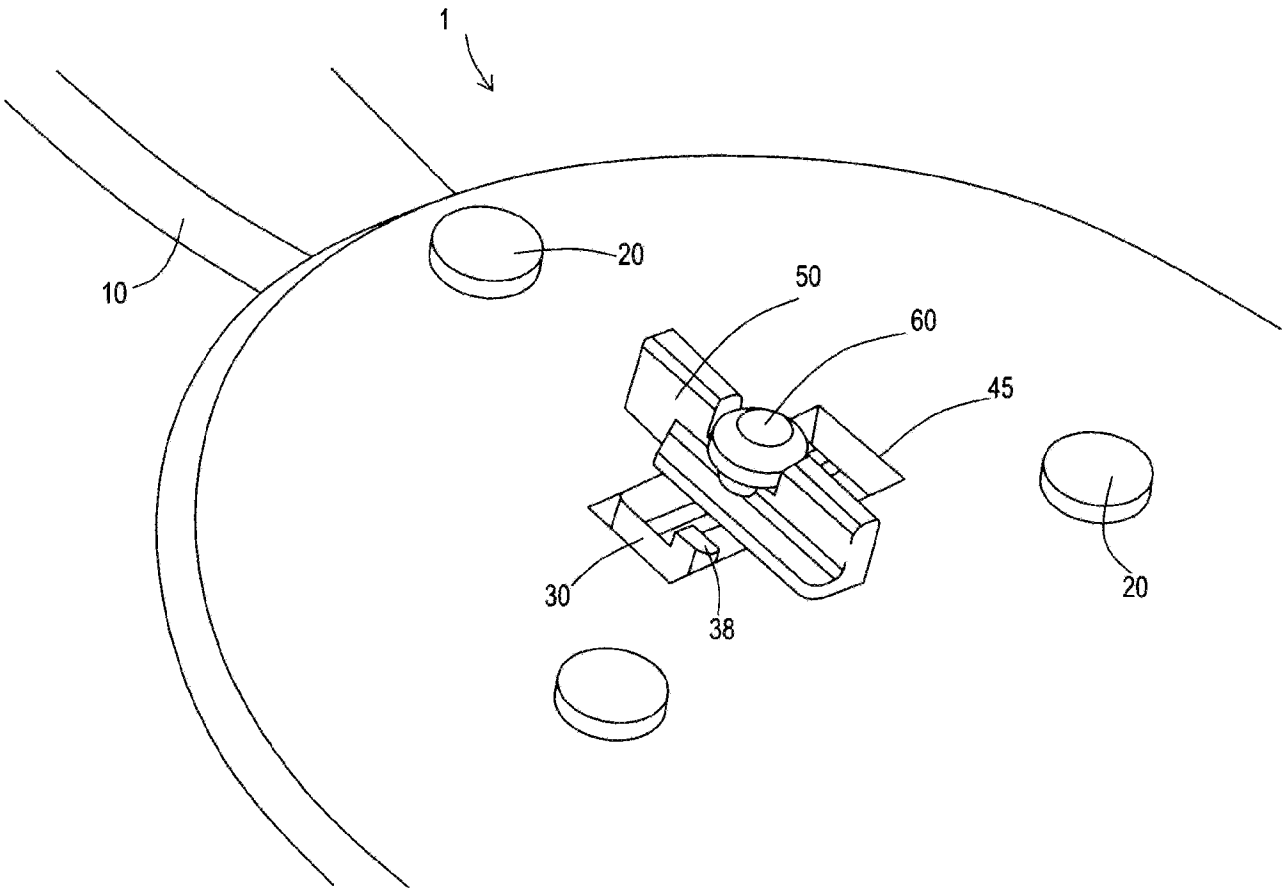
FIG. 4B is a perspective view of the ceiling fan blade of FIG. 1 attached to the bracket with knob in locked position.

FIG. 4A is a perspective view of the assembled blade 40 and bracket 10 with knob 50 in blade loading position. FIG. 4B is a perspective view of the ceiling fan blade 40 of FIG. 1 attached to the bracket 10 with knob 50 in a locked position.

Referring to FIGS. 1-4B, the blade bracket/iron can initially be positioned in a horizontal orientation with the posts 20 and pedestal 30 in a generally vertical position.

To start the assembly, the blade 40 can be held in a horizontal position raised above the bracket 10 so that the holes 42 and elongated slot 45 are positioned to be aligned with the posts 20 and pedestal 30. The Blade 40 is pushed onto and nested over the locating posts 20 and locating pedestal 30 until a lower portion of the blade 40 rests directly against an upper surface on the end 18 of the bracket 10.

Next, the knob 50 is gripped by ears 52 and is turned clockwise approximately 90 degrees in a parallel plane with the longitudinal axis of the blade, until the knob 50 locks into place against the upwardly protruding stop 38, which functions as an anti-rotation abutment on the pedestal 30. As the knob 50 turns, the lower surface of the base 54 which has the raised ridge 56 and sloping side surfaces 59 together generates compression on the top portion of the blade 40 holding the blade 40 rigidly in place. The sharp ridge 56 on the bottom of the knob 50 assures that the knob 50 will stay in place during operation of the ceiling fan.

When all the ceiling fan blades' are assembled in a similar manner, and the ceiling fan is mounted, the ceiling fan is ready to operate. Since the running ceiling fan will have a plurality of blades 40 that will be rotating, it is imperative that the blades 40 do not come loose during operation. The dimensional tolerance between the openings 42, 45 in the blade 40 and the locating features (posts 20 and pedestal 30) in the blade bracket 10 is critical.

Once the blade(s) 40 are locked in place the installed blade (s) 40 should not be able to move in any axis. For each assembled blade 40 and bracket 10, the turning knob 50 provides the downward force necessary to keep the blade 40 from moving up or down.

For this reason the blade 40 thickness relative to the locating pedestal 30 height in the blade bracket 10 is also critical in that it should provide adequate downward pressure on the blade 50 once the turning knob 50 is turned and locked in place. If the blade 40 is too thick the knob 50 will not be able to move and if it is too thin the knob 50 will not provide the necessary downward pressure. Once the assembly 1 is locked down, the 3 locating posts 20 and locating pedestal 30 hold the blade 40 in place in the blade bracket 10 in all lateral side-to-side directions.

The blade bracket 10 can be a die cast part (preferably from aluminum) with the critical locating features molded into the component so the posts 20 are consistent in size from part to part. The turning knob 50 can be a separate component that is pre-installed at the factory using a shoulder screw 60. The turning knob 50 can be made from durable plastic which will provide some forgiveness for tolerances as needed. The blade 40 can be made from plywood or mdf.

The openings 42, 45 in the blade 40 can be stamped or punched in a single operation to maintain consistency in size and hole pattern from part to part. Additionally, the openings/holes can be drilled. All the openings/holes can be formed simultaneously to ensure hole size tolerances are being maintained. The tolerance on the posts sizes 20 in the bracket 10 and the corresponding holes 42 in the blade 40 can be held very closely to assure a tight fit in the x and z axis of the blade 40.

The pattern of the locating posts 20 and/or locating pedestal/block 30 can be altered somewhat and still function acceptably. The sizes of the locating features (posts 20 and holes 42) can be larger or smaller and still function adequately.

To use this invention one simply needs to fit a blade 40 with a matched pattern of openings 20 over the locating features 20 on the blade bracket 10 until the blade 40 bottoms on the blade bracket 10. Next, the assembler turns the turning knob 50 clockwise until it locks in place against the positive stop feature 38 on the pedestal 30.

Figure 5:
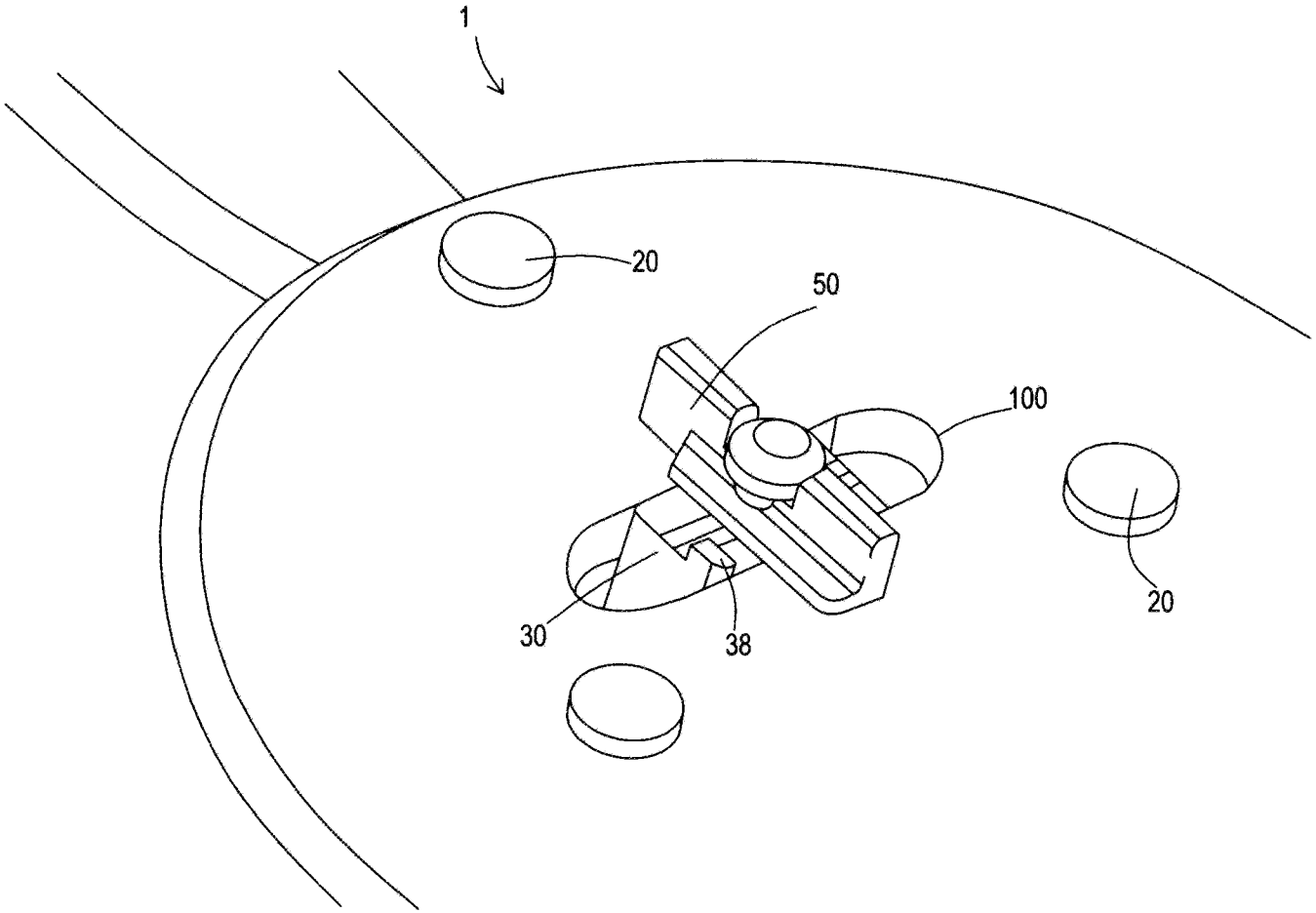
FIG. 5 is another perspective view of FIG. 4 with the fastening slot in the blade being oval instead of rectangle.

Although the knob 50, slot 45 are shown and described as being rectangular, these and other components such, as oval slot 100, cylindrical holes 42, cylindrical posts 20, can have other geometrical shapes, and are not limited by the descriptions above. For example, FIG. 5 is another perspective view of FIG. 4 with the fastening slot 100 in the blade being oval instead of rectangle.

Figure 6:
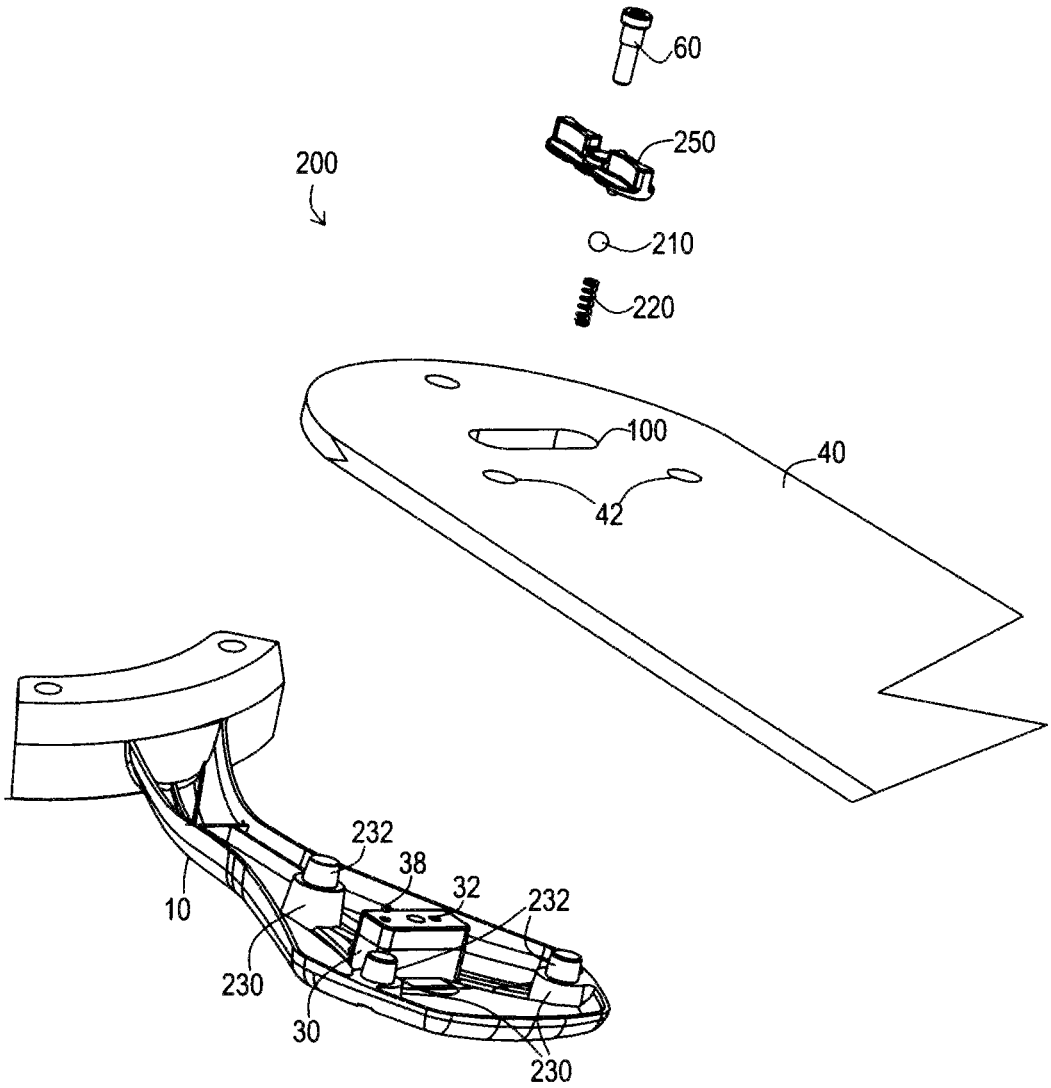
FIG. 6 is an exploded view of another embodiment of knob with spring detent to attach the blade to the blade bracket.
Figure 7:
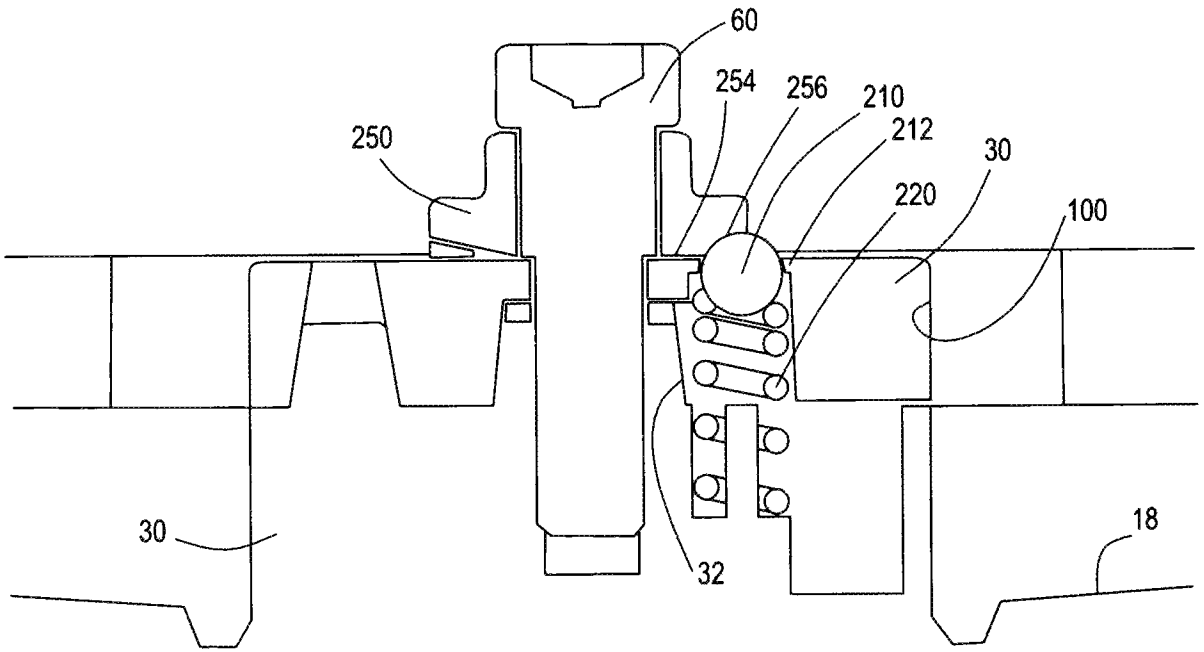
FIG. 7 is a cross-sectional view of FIG. 6 assembled with knob locked in position with spring detent.

FIG. 6 is an exploded view of another spring loaded embodiment 200 of a turning knob 250 with spring detent ball 210 and spring additionally used to attach the blade 40 to the blade bracket 10. FIG. 7 is a cross-sectional view of FIG. 6 assembled with the knob 250 locked in position with spring detent ball 210 and spring 220.

Referring to FIGS. 6-7, this embodiment 200 works and functionally similar to the previously described embodiments, with the additions of a modified enlarged post bases 230 and narrower post tops 232. The upper step edges on the bases 230 allow for surface of the bottom of the blade 40 to rest thereon. The narrow post tops 232 can be cylindrical or somewhat conical to create a tight fit in alignment holes 42.

A spring 220 can be located inside of a channel 32 in the upper surface 31 of the pedestal 30, with a ball 210 held in place by a ledge portion 212 about an upper part of the channel 32 so allow an upper portion of the ball to be pushed upward by the spring 220. The bottom 254 of the turning knob can constantly push the ball 210 downward into the channel 32, until a detent (depression) 256 on one side portion of the underside 254 of the knob 250 is reached when the knob 250 is rotated counter-clockwise. When the detent (depression) 256 is reached the upper portion of the ball 210 can push upward into the detent (depression) 256, causing the knob 250 to be held in place. The assembler can unlock the knob 250 by rotating clockwise with enough force to push the ball 210 downward into channel 32.

The connecting assembly components in this invention can additionally be used to assemble or connect multiple components that need to be held tightly together and all axis of movement in any rotating or static mechanical device or system.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A ceiling fan blade connecting device, comprising:

a fan blade with a mounting end having a single enlarged non-cylindrical fastening hole and an opposite end;

a blade bracket having one end attached to a ceiling fan motor and opposite blade connecting end;

a single non-cylindrical pedestal fixably attached in a vertical orientation to the blade connecting end of the bracket; and a single non-cylindrical rotatable knob rotatably attached to the single pedestal, wherein at rest position perimeter edges of the knob are aligned with perimeter edges of the pedestal, the knob having a base with downwardly protruding middle ridge portion and angled side portions which angle upward up to approximately 10 degrees to each side of the middle ridge portion, wherein the base enhances a gripping action with the surface of the blade when the knob is rotated, and wherein the blade is laid over the bracket so that the fastening hole slips over the knob and the pedestal until a portion of the blade rests against the bracket, and twisting the knob to a non-aligned position over the pedestal locks the blade to the bracket.

2. The ceiling fan blade connecting device of claim 1, wherein the non-cylindrical fastening hole is rectangular wherein the longitudinal axis of the rectangular hole is generally perpendicular to the longitudinal axis of the blade and the blade bracket.

3. The ceiling fan blade connecting device of claim 1, wherein the non-cylindrical fastening hole is oval wherein the longitudinal axis of the oval hole is generally perpendicular to the longitudinal axis of the blade and the blade bracket.

4. The ceiling fan blade connecting device of claim 1, wherein the non-cylindrical rotatable knob is rectangular wherein the longitudinal axis of the rectangular knob is generally perpendicular to the longitudinal axis of the blade and the blade bracket.

5. The ceiling fan blade connecting device of claim 1, wherein the non-cylindrical rotatable knob is oval, and wherein the longitudinal axis of the oval rotatable knob is generally perpendicular to the longitudinal axis of the blade and the blade bracket.

6. The ceiling fan blade connecting device of claim 1, further comprising:

a stop to limit the rotation of the knob to approximately 90 degrees.

7. The ceiling fan blade connecting device of claim 1, further comprising:

a plurality of posts attached in a vertical orientation to the blade connecting end of the bracket adjacent to the pedestal; and a plurality of cylindrical holes in the mounting end of the blade where the posts align the blade to the bracket.

8. The ceiling fan blade connecting device of claim 1, wherein the knob includes: a spring depressible detent to limit rotation of the knob in the locked position.

9. A ceiling fan, comprising:

a plurality of fan blades, each blade having a mounting end with a single enlarged non-cylindrical fastening hole and an opposite end;

a plurality of brackets, each bracket having one end attached to a ceiling fan motor and opposite blade connecting end;

a plurality of pedestal and knob assemblies, with one pedestal and knob assembly used to attach one blade to one bracket, each assembly having a single non-cylindrical pedestal fixably attached in a vertical orientation to the blade connecting end of the bracket and a single non-cylindrical rotatable knob rotatably attached to the single pedestal, each knob having a base with downwardly protruding middle ridge portion and angled side portions which angle upward up to approximately 10 degrees to each side of the middle ridge portion, wherein the base enhances a gripping action with the surface of the blade when the knob is rotated, wherein at rest position perimeter edges of the knobs are aligned with perimeter edges of the pedestals, and wherein the blades are laid over the brackets so that the fastening holes slips over the knobs and the pedestals until a portion of the blades rests against the brackets, and twisting the knobs to a non-aligned position over the pedestals locks the blades to the brackets.

10. The ceiling fan of claim 9, wherein each non-cylindrical rotatable knob is oval, and wherein each longitudinal axis of the oval rotatable knob is generally perpendicular to the longitudinal axis of the blade and the blade bracket.

11. The ceiling fan of claim 9, further comprising:

a stop to limit the rotation of the knob to approximately 90 degrees.

12. The ceiling fan of claim 9, wherein each pedestal and knob assembly includes:

a plurality of posts attached in a vertical orientation to the blade connecting end of the bracket adjacent to the pedestal; and a plurality of cylindrical holes in the mounting end of the blade where the posts align the blade to the bracket.

13. A method of assembling blades to blade brackets in a ceiling fan comprising the steps of:

providing a plurality of fan blades, each blade having a mounting end with a single enlarged non-cylindrical fastening hole and an opposite end;

providing a plurality of brackets, each bracket having one end attached to a ceiling fan motor and opposite blade connecting end;

providing a plurality of pedestal and knob assemblies, with one pedestal and knob assembly used to attach one blade to one bracket, each assembly having a single non-cylindrical pedestal fixably attached in a vertical orientation to the blade connecting end of the bracket and a single non-cylindrical rotatable knob rotatably attached to the single pedestal, each knob having a base with downwardly protruding middle ridge portion and angled side portions which angle upward up to approximately 10 degrees to each side of the middle ridge portion, wherein the base enhances a gripping action with the surface of the blade when the knob is rotated;

forming a rest position where perimeter edges of the knobs are aligned with perimeter edges of the pedestals;

laying the blades over the brackets so that the fastening holes slips over the knobs and the pedestals until a portion of the blades rests against the brackets; and twisting the knobs to a non-aligned position over the pedestals to lock the blades to the brackets.

* * * * *